US005746664A

United States Patent [19]

Reynolds, Jr.

[11] Patent Number: 5,746,664

[45] **Date of Patent: *May 5, 1998**

[54] GOLF PUTTER

[76] Inventor: Walker Reynolds, Jr., 14 Rendalia Rd., Anniston, Ala. 36201

[ * ] Notice: The term of this patent shall not extend beyond the expiration date of Pat. No. 5,533,725.

[21] Appl. No.: 585,938

[22] Filed: Jan. 16, 1996

Related U.S. Application Data

[63] Continuation-in-part of Ser. No. 387,175, Feb. 13, 1995, Pat. No. 5,533,725, which is a continuation-in-part of Ser. No. 241,278, May 11, 1994, Pat. No. 5,388,827.

[51] Int. Cl.[6] ..... A63B 53/02; A63B 53/04

[52] U.S. Cl. ..... 473/252; 473/334; 473/339; 473/313; 473/341; 473/297; 473/307; 473/312

[58] Field of Search ..... 473/305, 306, 473/307, 308, 309, 310, 311, 312, 313, 340, 341, 342, 343, 244, 245, 246, 247, 248, 251, 252, 253, 254, 296, 297, 334–339

[56] References Cited

U.S. PATENT DOCUMENTS

| | | | |
|---|---|---|---|
| D. 256,262 | 8/1980 | Benson | 473/253 |
| 1,455,379 | 5/1923 | Allen . | |
| 1,540,559 | 6/1925 | Murphy . | |
| 1,958,032 | 5/1934 | Cocke . | |
| 2,002,108 | 5/1935 | Child | 473/296 |
| 2,257,575 | 9/1941 | Reach . | |
| 3,430,957 | 3/1969 | Andis . | |
| 3,539,185 | 11/1970 | Andis | 473/296 |
| 3,606,327 | 9/1971 | Gorman . | |
| 4,111,426 | 9/1978 | Goodwin | 473/306 |
| 4,156,526 | 5/1979 | Huggins | 473/329 |
| 4,422,638 | 12/1983 | Tucker | 473/329 |
| 4,655,459 | 4/1987 | Antonious . | |
| 4,872,684 | 10/1989 | Dippel | 473/309 |
| 4,881,737 | 11/1989 | Mullins . | |
| 5,275,409 | 1/1994 | Currie | 473/306 |
| 5,348,295 | 9/1994 | Phillips | 473/314 |
| 5,390,918 | 2/1995 | Meyers et al. . | |
| 5,390,920 | 2/1995 | Nickum | 473/251 |
| 5,533,725 | 7/1996 | Reynolds | 473/307 |

FOREIGN PATENT DOCUMENTS

| | | | |
|---|---|---|---|
| 1118181 | 6/1968 | United Kingdom | 273/80.1 |

*Primary Examiner*—Sebastiano Passaniti
*Attorney, Agent, or Firm*—Veal & Associates

[57] ABSTRACT

A golf club, such as a putter, utilizes removable shafts, removable weights in the shaft grip end, a variable length adapter to connect the shaft to the putter head and vary the shaft end weight, and removable weights in the putter head to vary the pressure of the putter relative to the putting surface speed. The putter head also includes weighted inserts or plugs placed in the head during manufacturing to vary the weight of the putter head. The striking face has an additional insert at the striking point adapted to receive various types of plugs to vary the percussion response. Grooves on the top surface of the club head provide improved "sighting" of the golf ball in relation to the hole. The club head shape and grip end appearance remain unaltered and thereby retain user familiarity and confidence.

21 Claims, 4 Drawing Sheets

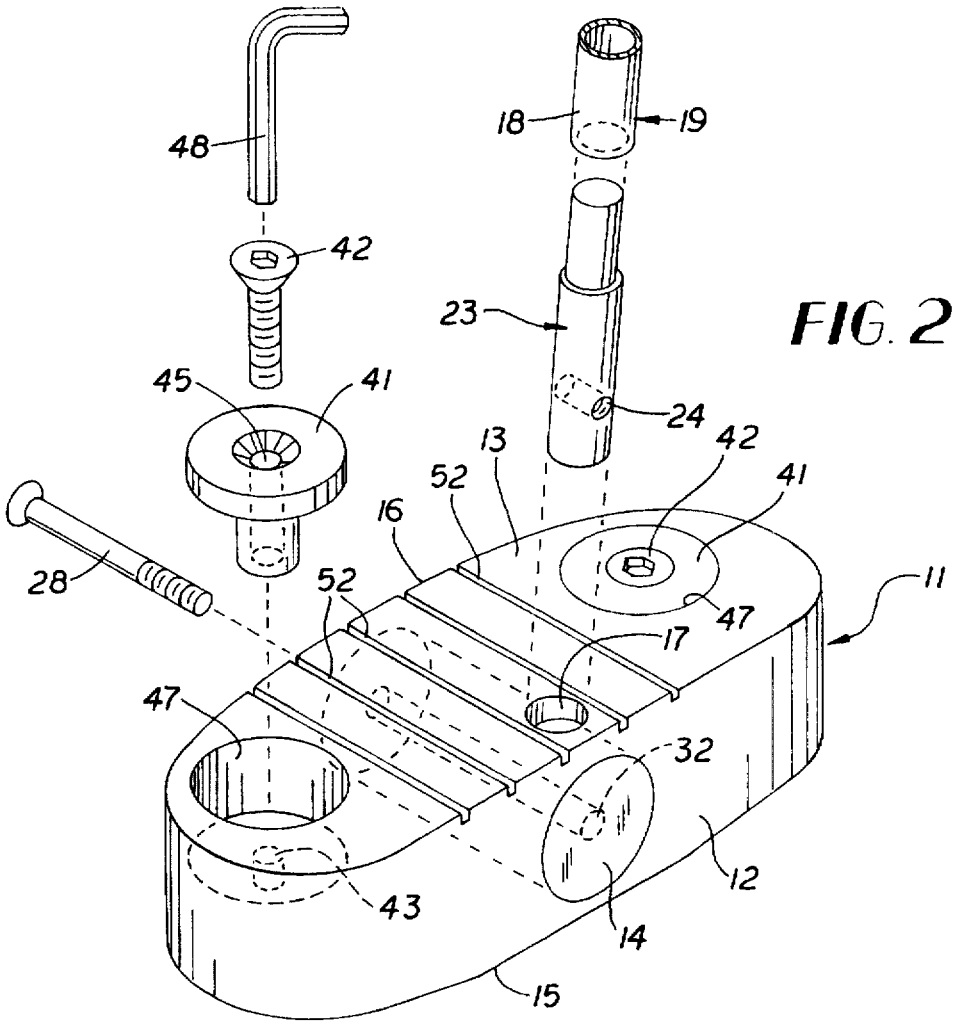
FIG. 2
FIG. 2A
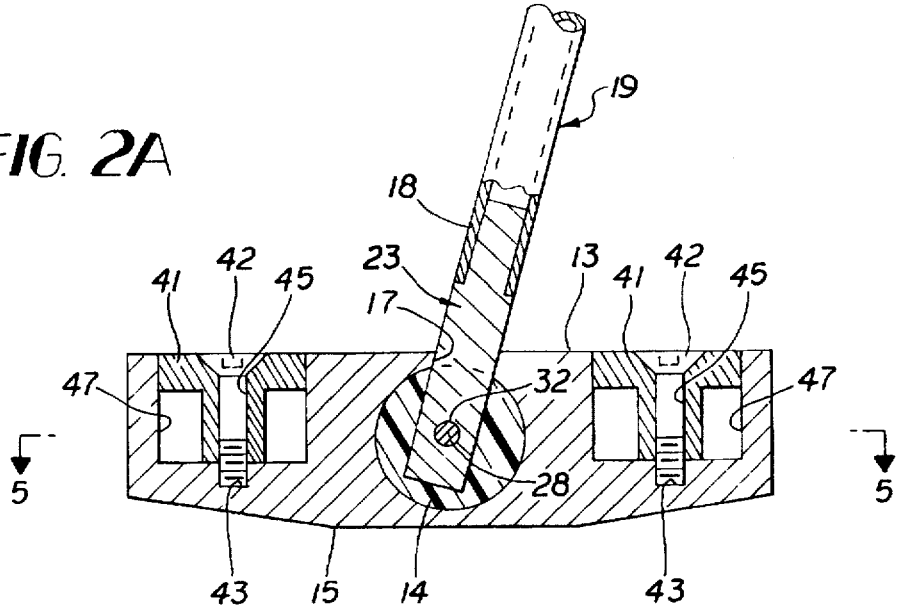

GOLF PUTTER

This is a continuation-in-part of application Ser. No. 08/387,175, filed Feb. 13, 1995, and now U.S. Pat. No. 5,533,725 which is a continuation in part of application Ser. No. 08/241,278 filed May 11, 1994 and now U.S. Pat. No. 5,388,827.

FIELD OF THE INVENTION

The present invention relates generally to the game of golf and more particularly to the putters used in the play of the game. In greater particularity, the present invention relates to the construction of putters, wherein the head of the putter may be detachable from the shaft, the striking surface may be varied, and the weight of the putter may be varied.

BACKGROUND

Golfing enthusiasts will appreciate that most golf clubs, including the putter, are manufactured in such a manner as to be unitized in construction. That is to say, the head and shaft are not readily separated from one another. Thus one is relegated to a single putter and is constrained to try many putters to get one that is satisfactory. It must be appreciated that putting is the most critical part of the golfer's game and that the saying "you drive for show, but you putt for dough!" emphasizes that the six foot putt counts just as much as the two-hundred and fifty yard drive, and that if the six foot putt is missed the subsequent six inch putt counts just as much as the other two. Also, the putter is the only club that the golfer expects to use on every hole. Thus, the confidence of the golfer in the putter is essential to enjoyment of the game and to being a competitive player.

The factor which is uncontrollable by the golfer is the speed of the greens on which he putts. The moisture content of the grass, the type of grass, the length of the grass, the proximity of water to the green, and the composition of the soil in the green, all affect the speed of the greens. Thus, playing on the same course on subsequent days often presents the golfer with greens that are remarkably different in speed on the same hole. Accordingly, a golfer who is intent on reducing his score will try to adjust his putter or his swing to accommodate the speed of the greens. In making an adjustment to the putter, the golfer may feel more secure using a shorter handled putter on faster greens or a lighter weighted putter on faster greens, yet subconsciously changing putters reduces the golfer's sense of well being. In other words, most golfers feel that they can hit their shots with their clubs better than they can with unfamiliar clubs including the putter, thus changing putter from day to day reduces the golfer's confidence. Likewise, if the golfer knows that the greens vary, he is somewhat concerned about using a putter that he cannot fine tune to the greens.

It is known that putters exist which can be adjusted in weight, including the inventor's own putter which is covered in U.S. Design Pat. No. D-282,480 and U.S. Utility Pat. No. 5,388,827. A further example of an adjustably weighted putter is Antonious, U.S. Pat. No. 4,655,459. Antonious discloses a weight distribution having weight centrally located below and behind the ball striking face and weight located at the toe and heel of the club vertically above the center of percussion.

It is also known that putters exist which address the need for a putter which is adjustable to suit different golfers'stances. For example, Mullins, U.S. Pat. No. 4,881,737 discloses a shaft connected to the golf head for adjustment of the incline of the shaft relative to the head between 16 degrees and 22 degrees. The shaft has an adapter forming a ball and socket connection with the club head in a central bore. Similarly, Meyers et al., U.S. Pat. No. 5,390,918, discloses an adjustable putter having a lower shaft with a spherical tip portion. A plurality of set screws engage the spherical tip within a socket in the club head allowing adjustment of the angle of the shaft relative to the head.

However, merely adjusting the weight of the head or the angle of the golf head relative to the club shaft is not always sufficient to put the golfer's mind at ease. In as much as golf is a mental game, the improvements described hereinafter allow the golfer to fine tune his putter from day to day to satisfy himself that the putter is "right" and that he can use the club properly.

SUMMARY OF THE INVENTION

It is the object of the invention to provide a putter which will improve the game of a golfer who uses it regularly.

It is an object of this invention to provide a golfer with a putter which retains its familiarity even though its functional characteristics are varied.

It is a further object of the invention to provide a putter which can be fine tuned by the golfer to suit his playing preference in accordance with the speed of the greens on which he is playing.

These and other objects and features of the invention are accomplished in the provision of a putter wherein the putter head remains the same in appearance in as much as the shape and size remain constant. The invention may be briefly described as allowing a golfer to vary the length of the shaft to which the putter head is attached, vary the weight of the putter grip end, vary the weight of the adapter that connects the club shaft to the putter head, vary the weight of the putter head, and vary the striking surface material. The weight may be altered during manufacturing by introducing different press-fit substances into the body of the putter head, or the user may alter the weight by exchanging different removable weights within the putter head and putter handle. A club shaft adapter may be selectively chosen to increase or decrease the weight of the club shaft end. The percussion response of the putter head may also be altered by introducing different inserts of varying material into the striking face of putter head at the striking point. A series of parallel grooves in the upper surface of the putter head enhance "sighting" of the ball in relation to the cup or flag.

BRIEF DESCRIPTION OF THE DRAWINGS

Apparatus embodying my invention are depicted in the appended drawings which form a part of this disclosure and wherein:

FIG. 2 is an exploded front view of the putter components of the head attachment, an exchangeable weight embodiment and tightening tool, and a percussion insert within the striking face;

FIG. 2A is a front sectional view of the head attachment and also shows an embodiment of a weight attachment and the adapter within the central bore and percussion insert;

DESCRIPTION OF THE PREFERRED EMBODIMENTS

Figure 1:
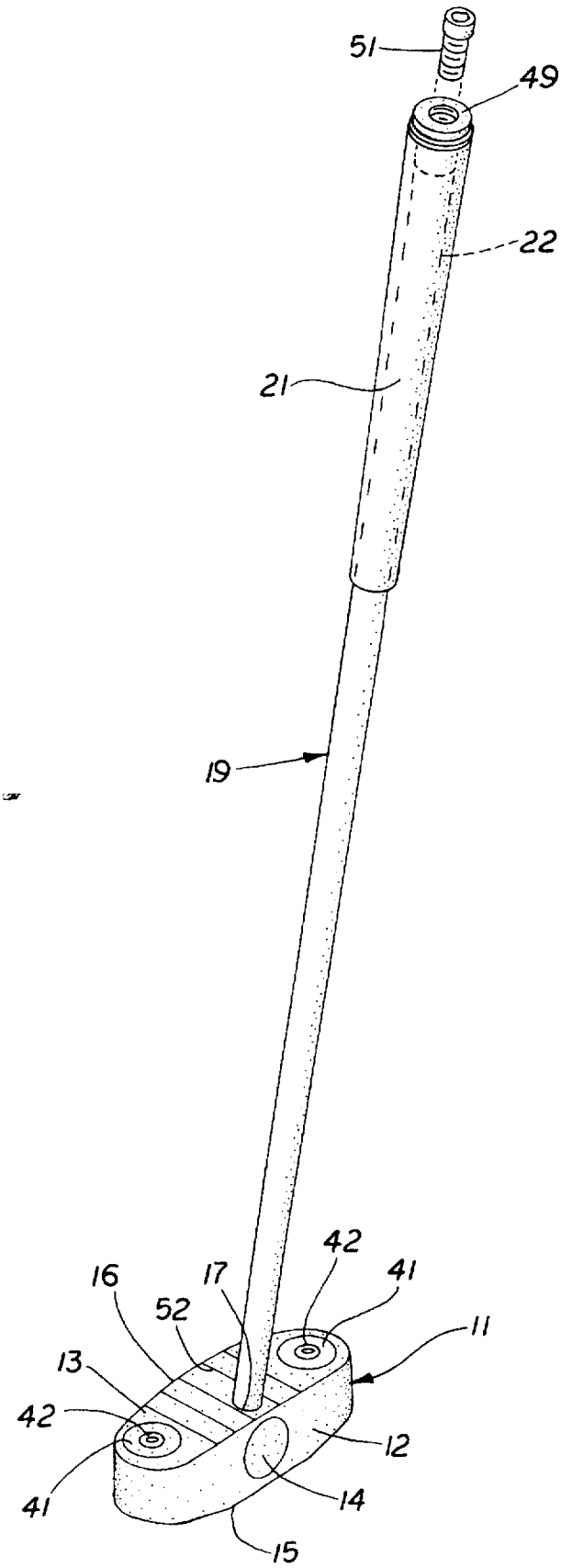
FIG. 1 is a perspective view of my putter.

Referring to the drawings for a clearer understanding of the invention it may be seen that the teaching of the instant disclosure are not limited to putters which share the same ornamental appearance as this putter, but rather are applicable to a variety of putter shapes. As may be seen in FIG. 1, the putter head is designated generally at 11 and includes a striking face 12, an upper surface 13, a lower surface 15, and a rear surface 16.

Referring to FIG. 2 and 2A, the upper surface 13 of the putter head has a central bore 17 formed therein which extends downwardly at an angle offset from normal to the upper surface 13 but parallel to the striking face 12. The bore 17 is appropriately sized to receive an adapter 23 of a shaft 19 at an end 18 in a snug fitting manner which allows insertion and withdrawal of the shaft 19 and extension 23 without deforming or galling of the adjacent surfaces. The opposite end 22 of the shaft carries thereon a grip 21 and will be referred to hereinafter as the grip end 22 with end 18 being referred to as distal end 18. The distal end 18 of the club shaft is pressed onto the adapter 23 and the central bore 17 receives the adapter 23 such that the flat end of the adapter rests upon the flat bottom of the central bore. It will be seen that the adapter may be made of various substances such as brass or steel and the length of the adapter varied to thereby adjust the weight of the shaft end. The adapter includes a transverse aperture 24 for receiving a set screw 28. An aperture 32 allows communication between rear surface 16 and the central bore 17. The set screw 28 passes through the aperture 32 and is threadably received by the transverse aperture 24 in the adapter upon alignment with the aperture 32. The set screw 28 is readily adjusted with an Allen wrench or the like to lock the adapter and, thereby, the distal end 18 of the shaft 19 into the head 11. It will also be understood that the set screw can be loosened to allow the shaft to be removed and replaced by a shaft of a different length, thus varying weight and pendulum forces of the putter. That is to say that it is known that a shorter putter requires the golfer to assume more of a crouch to putt properly which in turn can be a conditioned stimulus to use the putter more delicately, as one might on faster greens. In addition, a series of parallel grooves 52 n the upper surface 13 of the putter head 11 facilitates "sighting" of the ball in relation to the cup or flag. A golfer visually aligns the grooves with the flag or cup to help maintain a straight and true swing and follow through.

Figure 3:
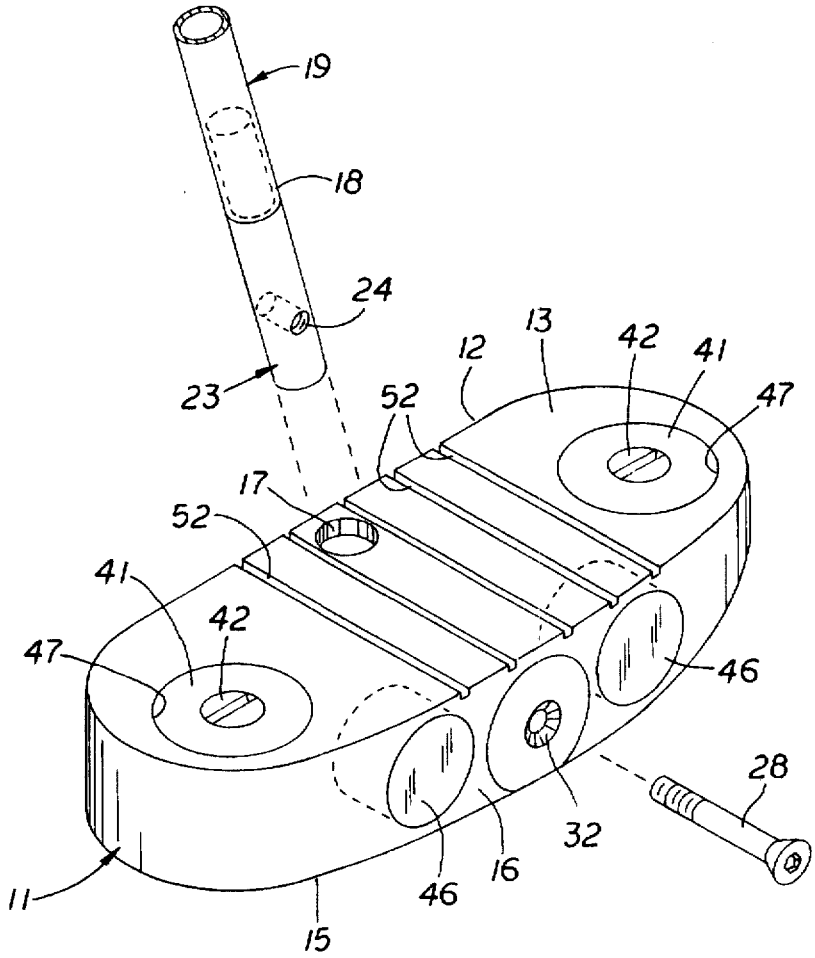
FIG. 3 is a rear perspective view of the putter components of the bead attachment and press-fit weight inserts.
Figure 3A:
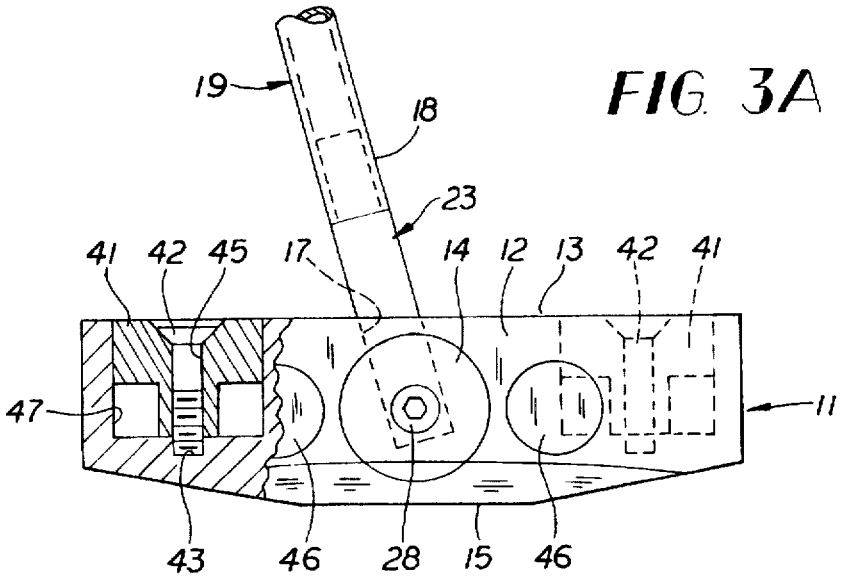
FIG. 3A is a rear sectional view of the head attachment and also shows an embodiment of exchangeable weights.

Referring again to FIG. 2 and FIG. 2A, it will also be appreciated that the weight of the putter head may be increased or decreased by varying the weight of a set of weight inserts 41 releasably secured within the head 11. As shown in FIG. 3 and 3A, the base weight of the head may also be adjusted by press-fitting different weighing substances 46 into the rear surface 16 of the head during manufacturing. Various substances such as stainless steel, brass, titanium, copper, plastic, and aluminum alloy may be pressed into the rear surface to adjust the head weight. In this manner, the club may attain a "counter balance" of mass which assists in truer strikes. That is to say, proper weight, weight distribution and shaft length can be attained in one club using my invention. Furthermore, the principle of weight distribution can be applied to all clubs from driver to putter using my invention.

Various strategies may be used to releasably secure the removable weights 41 within the putter head. FIG. 2 and 2A show an embodiment of a weight attachment. A weight 41 having flat top and a downward extending cylindrical portion with a central bore 45 is appropriately sized to fit snugly but smoothly within the weight recess 47 within the golf head 11. A retaining bolt 42 moves freely through a non-threaded weight bore 45 and engages a threaded recess 43 in the center of the weight recess 47 drawing the weight into a rigid secure position within the recess. Additional torque may be applied with a weight tightening or loosening tool 48 such as an allen wrench adapted to fit retaining bolt 42 in the flat top portion of the weight, thereby allowing easy exchange of variously sized weights.

Figure 4:
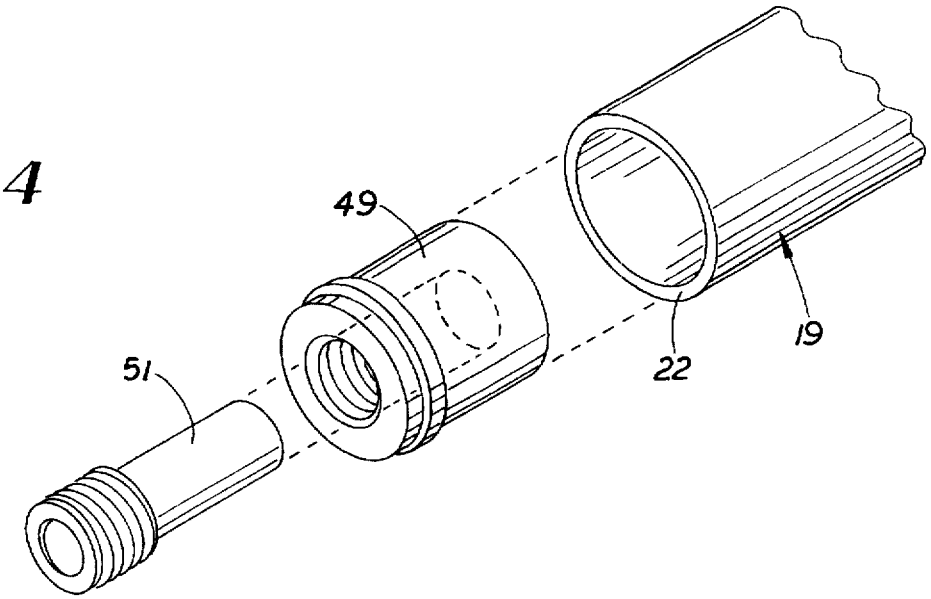
FIG. 4 is an exploded perspective view of the components of an embodiment of a grip end weight attachment.

Another adjustable weighting aspect of the invention is illustrated in FIG. 4. A shaft sleeve 49 may be press-fitted on to grip end 22 as shown. The sleeve has a central threaded bore for receiving a cylindrically shaped, cooperatively threaded shaft weight 51. The shaft weight 51 is composed of various heavy substances and may be replaced by other longer or shorter cooperatively threaded weights to adjust the overall weight of the putter grip end 22.

Figure 5:
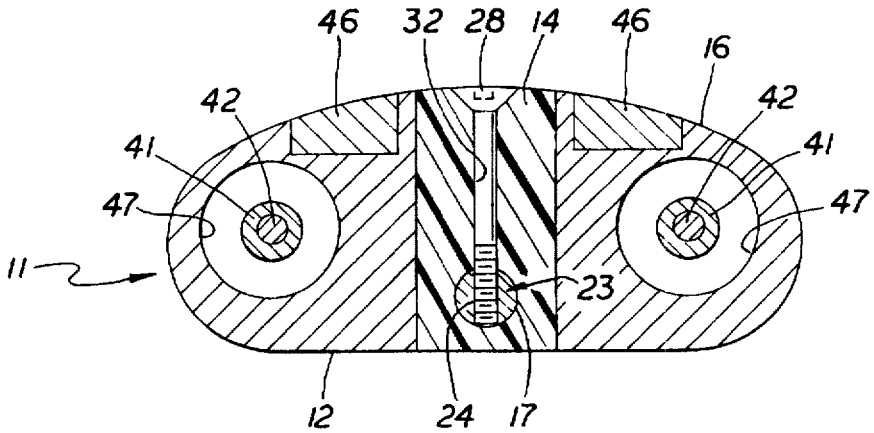
FIG. 5 is a section view taken along line 5—5 of FIG. 2A of the putter components of the head and also shows the percussion insert and set screw locking the adapter in the central bore.

FIG. 2 shows a percussion insert 14 flushly mounted in striking face 12, and FIG. 5 shows a top cross section view of the insert within the club head. Various types of substances may be used for inserts at the striking spot of the face to adjust the "sweet spot" of the striking face. A rigid material, such as steel or titanium, inserted into the face at the striking spot will increase the percussion response of a golf ball, thereby decreasing any spin that might be applied due to a angular swing. Conversely, a softer material, such as plastic, inserted into the face will decrease the percussion response of a golf ball, thereby increasing the application of spin due to an angled swing. By varying the inserted material, a golfer can adjust the percussion response of the putter to his or her swing and in relation to the characteristics of the green.

Typically, the percussion insert is a cylindrical plug that will be press-fitted into the club head 11 during manufacturing. The set screw aperture 32 is formed within the plug through which set screw 28 passes to lock adapter 23 into bore 17 as described above. However, the insert may also be fitted so that it passes freely through the head 11. In this embodiment, the plug is manually inserted by the golfer and, due to the central bore 17 formed through the upper surface of the club head, the plug will be locked in place with set screw 28 when the adapter is locked into place within the club head. In either embodiment, the insert will be flush with respect to the striking face and, as shown in FIG. 3, the insert may pass completely through the club head and form a portion of the rear surface thereof. A free fitting percussion insert will allow a golfer to exchange inserts in the middle of a round of play by simply removing the set screw and replacing the current insert with a cooperatively formed insert of a different material. The golfer can, therefore, vary the percussion response of his putter to suit the changing conditions of his swing and green conditions during the day.

While I have shown my invention in one form, it will be obvious to those skilled in the art that it is not so limited but is susceptible of various changes and modifications without departing from the spirit thereof.

Having set forth the nature of the present invention, what is claimed is:

1. A golf putter comprising in combination:

a) a shaft having a grip end and a distal end;

b) an adapter rigidly attached to said distal end and extending longitudinally therefrom;

c) a head having a striking face and an upper surface perpendicular to said striking face, said upper surface having a bore formed therein, oblique to the surface thereof and parallel to said striking face, of a dimension adapted to fixedly receive said adapter; and d) means for engaging said adapter within said bore for releasably securing the same to said head.

2. A golf putter as defined in claim 1 wherein said grip end includes at least one removable weight which selected form a group of cooperatively formed weights which can be selectively exchanged to adjust the overall weight of said grip end.

3. A golf putter as defined in claim 2 wherein said head includes at least one removable weight which selected from a group of cooperatively formed weights which can be selectively exchanged to adjust the overall weight of said head.

4. A golf putter as defined in claim 3 wherein said head includes press-fit plug weights for adjusting the overall weight of said head.

5. A golf putter as defined in claim 4 wherein said head includes a rear surface and said means for engaging comprises:

a) an aperture substantially perpendicular to said striking face providing communication between said rear surface and said bore; and b) a set screw received in said aperture, said screw having a threaded end intersecting said adapter for securing same within said bore.

6. A golf putter as defined in claim 5 wherein said shaft is replaceable with an alternative shaft of a different length to provide a putter of a different length.

7. A golf putter as defined in claim 6 wherein said upper surface includes a plurality of parallel grooves for sighting a golf ball.

8. A golf putter as defined in claim 2 wherein said adapter is weighted such that said adapter can be selectively exchanged with cooperatively formed adapters to adjust the overall weight of said distal end.

9. A golf putter as defined in claim 1 wherein said adapter is weighted such that said adapter can be selectively exchanged with cooperatively formed adapters to adjust overall weight of said distal end.

10. A golf putter as defined in claim 9 wherein said head includes press-fit plug weights for adjusting the overall weight of said head.

11. A golf putter as defined in claim 10 wherein said head includes a rear surface and said means for engaging comprises:

an aperture substantially perpendicular to said striking face providing communication between said rear surface and said bore; and a set screw received in said aperture, said screw having a threaded end intersecting said adapter for securing same within said bore.

12. A golf putter comprising a combination a) a shaft having a grip end and a distal end, said grip end including at least one removable weight selected form a group of cooperatively formed weights which can be selectively exchanged to adjust the overall weight of said grip end;

b) an adapter, selected form a group of cooperatively formed adapters, rigidly attached to said distal end and extending longitudinally therefrom, and wherein said adapter is weighted such that said adapter can be selectively exchanged with any of said group of cooperatively formed adapters to adjust the overall weight of said distal end;

c) a head having a striking face and an upper surface perpendicular to said striking face, said upper surface having a bore formed therein, oblique to the surface thereof and parallel to said striking face, of a dimension adapted to fixedly receive said adapter, and wherein said striking face includes an insert for adjusting the percussion response of said striking face; and, d) means for engaging said adapter within said bore for releasably securing the same to said head;

13. A golf putter as defined in claim 12 wherein said insert is removable so that said insert can be selectively exchanged with cooperatively formed inserts for adjusting the percussion response of said striking face.

14. A golf putter comprising in combination:

a) a shaft having a grip end and a distal end;

b) an adapter rigidly attached to said distal end and extending longitudinally therefrom;

c) a head having a striking face and an upper surface perpendicular to said striking face, said upper surface having a bore formed therein, oblique to the surface thereof and parallel to said striking face, of a dimension adapted to fixedly receive said adapter, and wherein said striking face includes an insert for adjusting the percussion response of said striking face; and, d) means for engaging said adapter within said bore for releasably securing the same to said head.

15. A golf putter as defined in claim 14 wherein said grip end includes at lease one removable weight selected from a group of cooperatively formed weights which can be selectively exchanged to adjust the overall weight of said grip end.

16. A golf putter as defined in claim 14 wherein said head includes at least one removable weight selected from a group of cooperatively formed weights which can be selectively exchanged to adjust the overall weight of said head.

17. A golf putter as defined in claim 16 wherein said head includes press-fit plug weights for adjusting the overall weight of said head.

18. A golf putter as defined in claim 14 wherein said insert is removable and selected form a group of cooperatively formed inserts so that said insert can be selectively exchanged for adjusting the percussion response of said striking face.

19. A golf putter as defined in claim 18 wherein said head includes a rear surface and said means for engaging comprises:

a) an aperture substantially perpendicular to said striking face providing communication between said rear surface and said bore through said insert; and b) a set screw received in said aperture, said screw having a threaded end intersecting said adapter for securing same within said bore.

20. A golf putter as defined in claim 14 wherein said adapter is weighted and selected from group of cooperatively formed adapters such that said adapter can be selectively exchanged to adjust the overall weight of said distal end.

21. A golf putter as defined in claim 14 wherein said head includes a rear surface and said means for engaging comprises:

a) an aperture substantially perpendicular to said striking face providing communication between said rear surface and said bore; and b) a set screw received in said aperture, said screw having a threaded end intersecting said adapter for securing same within said bore.

* * * * *